US006626556B2

(12) United States Patent
Galli

(10) Patent No.: US 6,626,556 B2
(45) Date of Patent: Sep. 30, 2003

(54) REVERSE OPERATING INLINE FLASHLIGHT SWITCH MECHANISM

(76) Inventor: Robert D. Galli, 8176 Horseshoe Bend La., Las Vegas, NV (US) 89113

( * ) Notice: Subject to any disclaimer, the term of this patent is extended or adjusted under 35 U.S.C. 154(b) by 2 days.

(21) Appl. No.: 10/080,164

(22) Filed: Feb. 21, 2002

(65) Prior Publication Data

US 2002/0114154 A1 Aug. 22, 2002

Related U.S. Application Data

(60) Provisional application No. 60/270,657, filed on Feb. 22, 2001.

(51) Int. Cl.[7] ..... F21L 4/04

(52) U.S. Cl. ..... 362/205; 362/188; 362/197; 362/203; 200/60

(58) Field of Search ..... 362/202, 187, 362/188, 197, 203, 204, 205, 206; 200/60, 572, 332.2, 17 R, 52 R

(56) References Cited

U.S. PATENT DOCUMENTS 4,956,755 A * 9/1990 Maglica et al. ..... 362/206
5,091,611 A * 2/1992 Reeves et al. ..... 200/60
5,158,358 A * 10/1992 Maglica et al. ..... 362/206
5,542,905 A * 8/1996 Nussenbaum ..... 600/197

* cited by examiner

*Primary Examiner*—Sandra O'Shea
*Assistant Examiner*—John Anthony Ward
(74) *Attorney, Agent, or Firm*—Barlow, Josephs & Holmes, Ltd.

(57) ABSTRACT

The present invention discloses an inline switch mechanism that operates in a reverse direction, making electrical contact as the flashlight head is unscrewed. The switch has an outer housing, an inner contact tube, a plunger, a contact spring, an insulator disk and a secondary spring. All of the components are electrically conductive with the exception of the insulator disk and outer housing. In the off position, the plunger floats, centered in the contact tube, with a contact end in electrical communication with the battery. A contact spring is disposed around and in electrical communication with the plunger. The insulator disk is on the back of the plunger supporting it and isolating it from the contact tube and is disposed between the plunger and the secondary spring. The secondary spring at one end exerts pressure on the insulating disk and thereby the plunger maintaining contact on the battery and at the other end contacts one side of the LED bulbs and is in electrical communication with the contact tube.

9 Claims, 4 Drawing Sheets

REVERSE OPERATING INLINE FLASHLIGHT SWITCH MECHANISM

PRIORITY CLAIM TO EARLIER FILED APPLICATION

This application claims priority from Provisional Patent Application No. 60/270,657, filed Feb. 22, 2001.

BACKGROUND OF THE INVENTION

The instant invention relates a switch mechanism that has an improved method of operation for use in flashlights. More specifically, this invention relates to an internal, inline switch mechanism for a flashlight that operates in a reverse direction to increase the reliability of the switch and provide an extended switch contact duration.

Flashlights of varying sizes and shapes are well known in the art. A number of such designs are known that utilize two or more batteries as their source of electrical energy, carried in series in a tubular body, where the tubular body also serves as a handle for the flashlight. Typically, an electrical circuit is established from one terminal of the battery, through a conductor to an external switch and then through another conductor to one contact of a bulb. After passing through the filament of the bulb, the electrical circuit emerges through a second contact of the bulb in electrical contact with a conductor, which in turn is in electrical contact with the flashlight housing. The flashlight housing provides an electrically conductive path to the other terminal at the rear of the battery. Actuation of the external switch completes the electrical circuit enabling electrical current to pass through the filament of the bulb, thereby generating light that is then typically focused by a reflector to form a beam of light.

In general, these flashlight switch mechanisms operate in two basic manners. The first mechanism is a pushbutton type switch on the side or bottom of the light. The user depresses the switch, which locks into the engaged position, turning the flashlight on. To turn the light off, the user again depresses the switch, unlocking it and turning the light off. Often, if a watertight seal is desired, a rubberized material is installed into the body of the flashlight as a covering over the switch mechanism. This design has several drawbacks. One drawback is that the increased number of parts creates additional assembly steps and increases the difficulty of assembly process. Another drawback is the possibility of leaks developing as the rubber membrane wears out from the stretching action resulting from continuous use.

In an attempt to resolve the drawbacks noted above with respect to the push-button type switches, a second type of rotatable switch was developed for in-line use in flashlights. In one design, an end cap is rotatably secured to the flashlight body. To establish the required electrical contact, the end cap is rotated making contact to illuminate the lamp bulb. A number of such prior art designs feature rotatable end caps which are rotated to move the batteries longitudinally within the flashlight body towards the lamp bulb, thereby causing contact between the battery contact and the base contact of the lamp bulb. In the open position, the battery is typically spring biased away from the base contact of the bulb.

In other designs, miniature flashlights have been designed where the rotatable switch is located in the reflector end of the flashlight body. The lamp bulb is located within an insulated receptacle at the reflector end of the flashlight with one or more conductive pins being rotatably aligned by movement of the switch portion of the device to establish electrical contact. While these switch mechanisms are internal to the device and thus less subject to damage, they are overly complicated in design and more costly to manufacture and require higher assembly tolerances.

In addition, the types of switches described above all generally operate in a forward direction, meaning that as the user turns the head or tail of the flashlight, tightening it onto the body of the flashlight, switch contact is eventually made thereby turning the flashlight on. Electrical contact, in this type of switch, is achieved by bringing a spring contact on the inside of the flashlight into contact with one pole of the battery contained within the body. These types of switches are problematic because the components of the flashlight are not always firmly holding the batteries in place. For example, when the flashlight is in the off position, the head is generally partially unscrewed from the body of the flashlight, preventing the spring on the back of the head from contacting the battery. This arrangement, however, also prevents the battery from being restrained, allowing the battery to freely float within the flashlight body. In addition, the range of switch contact is very limited, thus providing a very low tolerance switch mechanism that does not operate smoothly.

It is therefore and object of the present invention to provide an improved flashlight switching mechanism that is entirely self contained and completely waterproof. It is a further object of the present invention to provide a switching mechanism for a flashlight that has improved operating characteristics, such as increased contact duration and smoother operation. It is yet another object of the present invention to provide an in-line flashlight switching mechanism that is completely enclosed within the body of a flashlight thereby eliminating the possibility of contamination and damage from external forces.

SUMMARY OF THE INVENTION

In this regard, and in furtherance of the above stated objectives, the present invention provides a unique inline switch mechanism that is fully integrated into a flashlight head to provide a completely self contained and waterproof switching mechanism. The present invention further provides an inline flashlight switch mechanism that operates in a reverse direction whereby the switch makes electrical contact as the flashlight head is unscrewed. This is in contrast to the above-described switches that generally operate in a forward direction. This manner of operation allows the present invention to provide an extended operational range of positive electrical contact duration, while also producing a smoothly operating switch having broad operational tolerance.

The basic structure of the switch contains several operational components including a switch housing, a contact tube, a plunger, a contact spring, an insulator disk and a secondary spring. All of the components are electrically conductive with the exception of the insulator disk and the switch housing. The switch housing contains all of the other operational components of the switch and serves to selectively isolate them electrically from the body of the flashlight. In the off position, the plunger floats, centered in the contact tube, with the contact end in electrical communication with the battery. The contact spring is disposed around and is frictionally retained at the end of the plunger opposite the contact end. Both the plunger and the contact spring are in electrical communication thereby making the contact spring and plunger electrically hot. The insulator disk is installed onto the back of the plunger, supporting in the center of the contact tube and electrically isolating it from the walls of the contact tube. The insulator disk is also disposed between the plunger and the secondary spring electrically isolating these two components from one another as well. The secondary spring at one end exerts pressure on the insulating disk and thereby on the plunger maintaining the plunger in contact with the battery at all times during the operational range of the switch. At the other end, the secondary spring is in electrical communication with one contact of the LED bulbs and is also in electrical communication with the walls of the contact tube.

In a normally open position, the contact spring is displaced from the bottom wall of the contact tube. As the flashlight head is unscrewed the switch mechanism, retained within the head of the flashlight, moves away from the batteries while the plunger remains in place in contact with the battery due to the force of the secondary spring. Once the head is displaced far enough, the bottom wall of the contact tube comes into electrical communication with the contact spring allowing electricity to flow to the LED's. Since the spring force of the contact spring is less than that of the secondary spring, the contact tube continues to move, further compressing the contact spring while maintaining contact with the contact spring and keeping the contact end of the plunger in electrical communication with the battery as the flashlight head is turned through several rotations.

Other objects, features, operational details and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
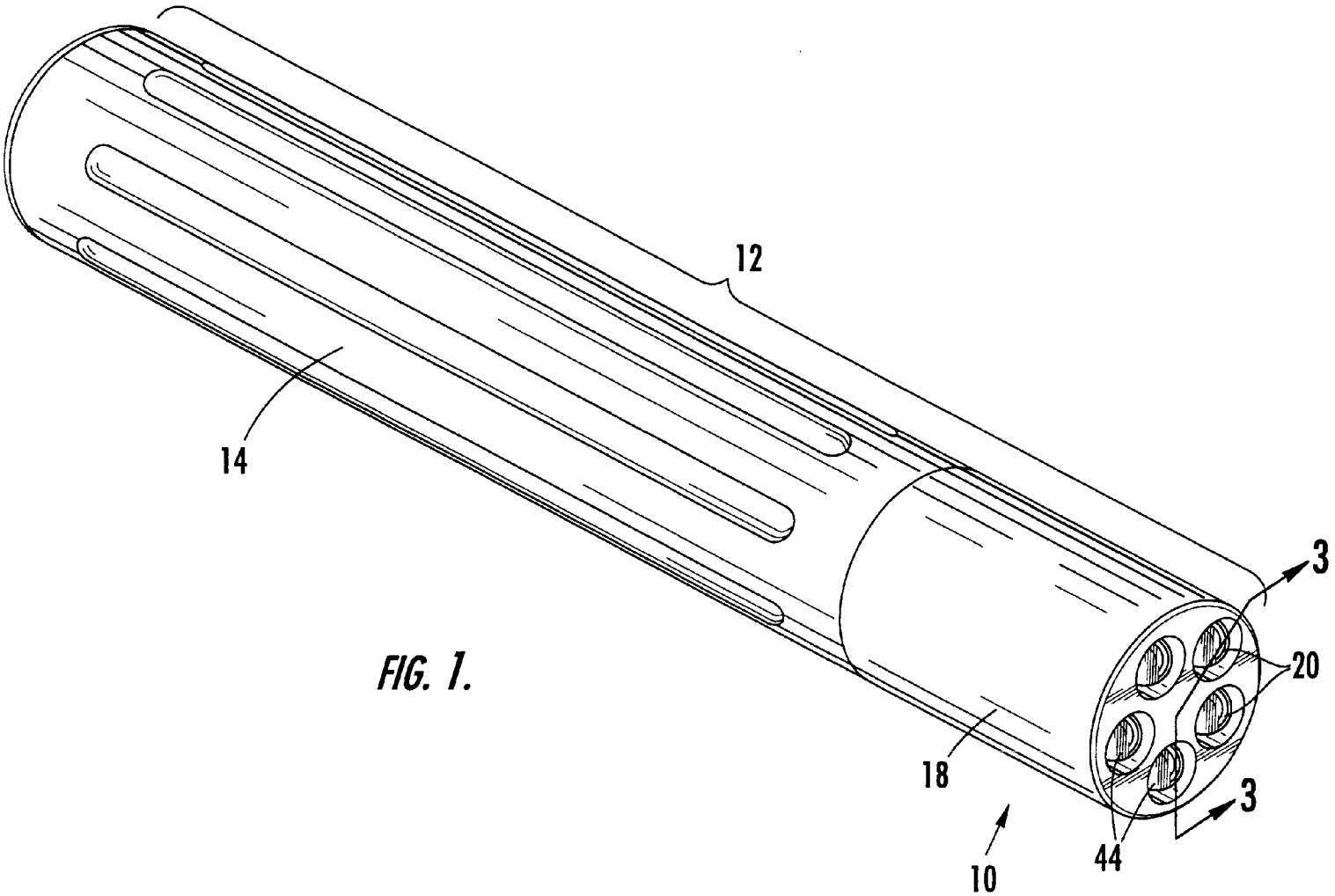
FIG. 1 is a perspective view of a flashlight containing the reverse operating switch mechanism of the present invention.

Referring now to the drawings, a completed flashlight assembly incorporating the reverse-acting switch mechanism of the present invention is generally indicated at 12 in FIGS. 1—3*a*. While the reverse switch mechanism is shown incorporated into a flashlight in the description of the preferred embodiment, the present disclosure provides that the switch mechanism described can be incorporated into a variety of other devices that require an inline switch having the same or similar operational characteristics. As will hereinafter be more fully described, the present invention provides a fully contained waterproof inline flashlight switch that provides improved operating features, higher durability and easier assembly as compared to similar flashlights in the prior art. The entire assembly is contained in a simple housing to provide a useful, novel and improved light source.

The flashlight 12 generally includes an elongated housing 14, batteries 16 disposed in the housing 14, and a flashlight head portion 10.

The flashlight head 10 has an outer enclosure 18 that at least partially encloses at least one light emitting diode (LED) 20, and a circuit component 22, as well as the reverse switch assembly.

Figure 2:
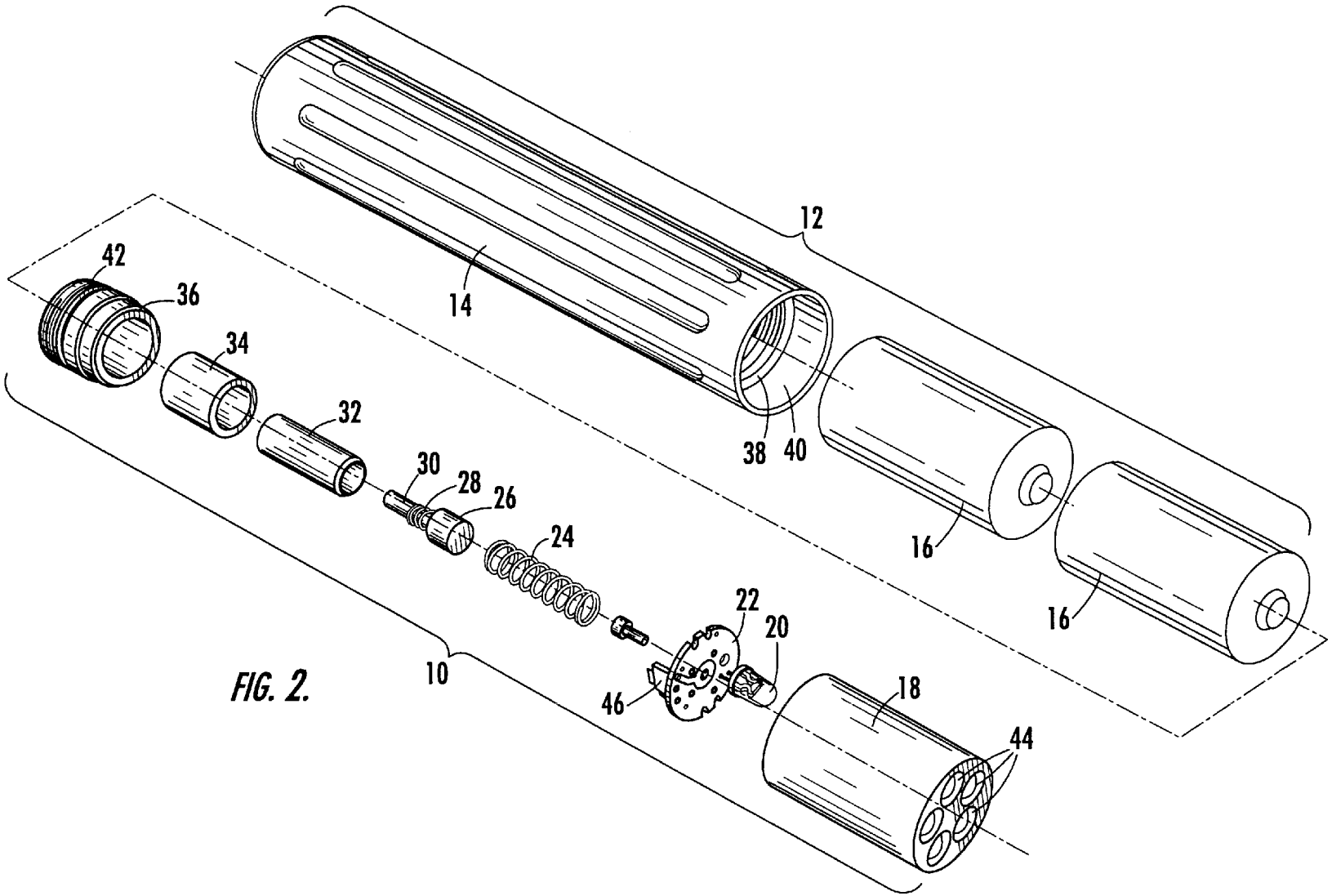
FIG. 2 is an exploded perspective view thereof.

The reverse switch assembly is best shown in FIG. 2, and includes a spring 24, an insulator disk 26, a contact spring 28, a plunger 30, a contact tube 32, and a switch housing 34. The flashlight head 10 further includes a lower enclosure 36 assembled in a permanent fashion to the outer enclosure 18 to enclose both the switching assembly and light source 20 of the flashlight 12 inside the flashlight head 10.

Turning to FIG. 1 an assembled view of the flashlight 12 of the present invention is shown. The outer shape of the flashlight 12 is formed by the battery housing 14 and the outer enclosure 18 of the flashlight head 10 where the battery housing 14 also serves as the handle for the flashlight 12. Both the battery housing 14 and the outer enclosure 18 are formed of a metallic material such as milled aluminum or stainless steel. This allows both of these components to be electrically conductive and employed as components of the overall circuitry of the flashlight 12 as will be further described below.

FIG. 2 shows the flashlight 12 and the flashlight head 10 of the present invention in an exploded perspective view, illustrating the general relationship between all of the components in the overall device. The battery housing 14 is generally tubular in shape having a closed bottom and an open top. The battery housing 14 is generally hollow with an opening 38 that is of a diameter particularly suited to receive batteries 16. In the preferred embodiment, the battery housing 14 is shown of a dimension to accept two batteries 16, however, the present invention will operate equally well using one, three, four or more batteries 16 and the length of the battery housing 14 will be adjusted accordingly to accommodate the number of batteries 16 used. The inner surface of the open end 38 of the battery housing 14 has female threads 40 that are designed to engage corresponding male threads 42 on the lower enclosure 36 thereby maintaining the flashlight 12 in an assembled condition and allowing the head portion 10 to be rotated relative to the battery housing 14. Rotation of the head 10 relative to the housing 14 selectively adjusts the relative positions to one another. When the batteries 16 are installed into the battery housing 14 one contact of the battery 16 is in electrical communication with the bottom of the battery housing 14. Since the battery housing 14 is metallic, electricity is therefore conducted from the battery 16 contact, through the bottom of the battery housing 14 and up through the battery housing 14 into the flashlight head 10 as will be further described below.

The head 10 portion of the flashlight 12 has an outer enclosure 18 that receives and houses all of the switching components and the light source of the flashlight. The outer enclosure 18 is also formed of a machined metallic material that is electrically conductive, such as machined aluminum or stainless steel. The outer enclosure 18 is cylindrically shaped, having an opening at one end into which all of the remaining components are installed and several smaller openings 44 at the other end through which the installed LED lamps 20 protrude. Circuit assembly 22 is typically a printed circuit board onto which the LED lamps 20 are mounted. The circuit assembly 22 has circuit traces connecting one pole of each LED 20 to a metal connection tab 46 and the other pole of each LED 20 to a central connection point 52 on the bottom surface of the circuit assembly 22. Once the LED lamps 20 are installed onto the circuit assembly 22, it is slid into the opening in the outer enclosure 18, so that the LED lamps 20 protrude through the openings 44 in the outer enclosure 18. The connection tab 46 is in electrical communication with the wall of the outer enclosure 18, thereby completing a path of electrical conductivity from the first contact of battery 16, through the battery housing 14 up into the outer enclosure 18 of the head and into the circuit assembly 22 through connection tab 46. The remaining portion of the electrical circuit is completed through the switch components as will be discussed below. In addition to providing paths of conductivity to each of the LED lamps 20, the circuit assembly 22 may also include additional circuitry for controlling the flow of current through the LED lamps 20 or to provide additional functionality, such as flashing, to the flashlight 12.

The principal component of the switch mechanism is plunger 30. The plunger 30 is substantially cylindrical and formed from a metallic material such as machined brass. One end of the plunger 30 is in contact with the second contact end of the battery 16 when the flashlight 12 is fully assembled. The opposite end of the plunger has a raised shoulder 48. The raised shoulder 48 serves to retain contact spring 28 in an operative position on the plunger 30. During assembly, the contact spring 28 is slid onto the plunger 30 and is pressed onto the raised shoulder 48 so that the spring is frictionally retained and in firm electrical communication with the plunger 30. Further, insulator disk 26 is attached to the end of the plunger 30 opposite the battery 16 contact. This sub-assembly (plunger 30, contact spring 28 and insulator disk 26) is then slid into contact tube 32.

Contact tube 32 is a cylindrically shaped tube that is open on the top end and has a bottom wall. The bottom wall has an opening 54 that has a diameter slightly greater than the diameter of the plunger 30. The remaining portion of the bottom wall forms switch contact 50. The plunger 30, contact spring 28 and insulator disk 26 are slid into the open end of the contact tube allowing the contact end of the plunger to protrude through the opening 54 in the bottom wall of the contact tube 32 without making physical or electrical contact with switch contact 50. In this regard, the insulator disk 26 is sized to have a diameter that is only slightly smaller than the diameter of the contact tube 32. This allows the insulator disk 26 to slide freely up and down inside the contact tube 32 while supporting the plunger 30 in the center of the contact tube 32 and preventing the plunger 30 from contacting the sides of the contact tube 32. The insulator disk 26 is formed from a non-conductive material and is preferably a plastic material. Biasing spring 24 is then installed into the contact tube 32 behind the insulator disk 26. The biasing spring 24 has a diameter that is also only slightly smaller than the inner diameter of the contact tube 32 and is in electrical communication with the inner walls of contact tube 32 and with the central connection point 52 on the circuit assembly 22 when the entire flashlight head 10 is assembled. The contact tube 32 including the switch components described above is installed into the switch housing 34, which consists of cylindrical support housing that is electrically insulative and designed to isolate contact tube 32 from the rest of the flashlight head assembly 10.

The switch housing 34, after the above-described assembly, is then placed into the lower enclosure 36. The lower enclosure 36 is a metallic component having an opening in its center into which the entire switching assembly is placed. The lower enclosure has an opening in its center to allow the plunger 30 to protrude and contact the battery 16 in an assembled position. The lower enclosure 36 also has male threads 42 that correspond to the female threads 40 on the interior of the battery housing 14. To complete the assembly of the head 10, the lower enclosure 36 containing all of the switching components, is pressed into the outer enclosure 18 using a hydraulic press (not shown) or similar method known in the art. This provides a completed flashlight head 10 that is sealed, having no parts that are accessible by the user. The head 10 is then threaded into the battery housing 14, which already contains batteries 16 to complete the assembly of the flashlight 12. To further seal the flashlight assembly 12 and prevent water infiltration, an O-ring gasket 56 is provided in a groove 58 in the side of lower enclosure 36. The O-ring gasket 56 serves to seal the operable junction between the flashlight head 10 and the battery housing 14 prevent infiltration of water or other contaminants. Additionally, sealant 60 in the form of a UV curable potting compound is installed in the gap between the LED lamps 20 and the openings 44 in the outer enclosure 18 to further prevent infiltration to the interior of the flashlight 12.

Figure 3:
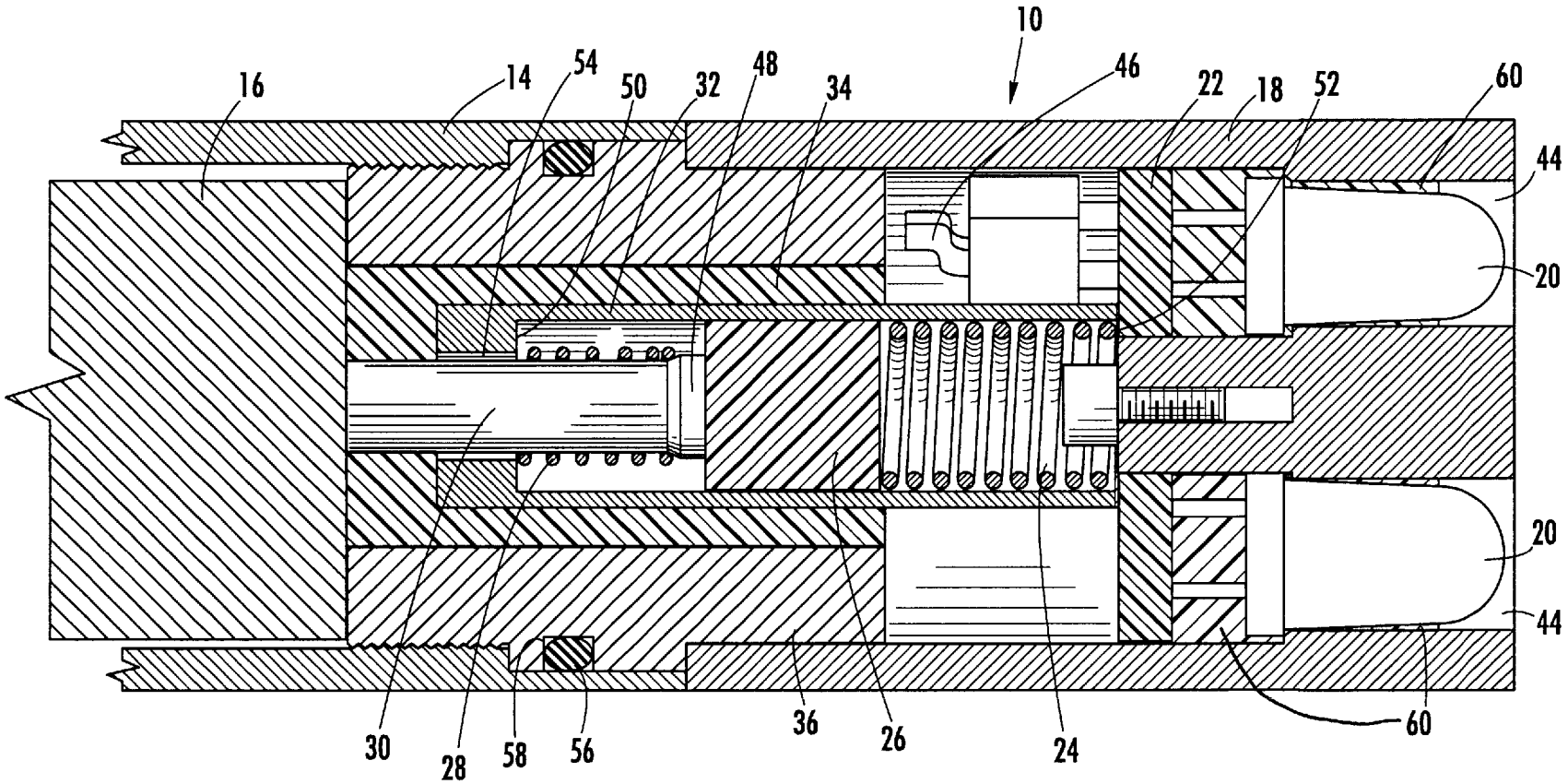
FIG. 3 is a cross-sectional view of the flashlight of the present invention in FIG. 1 along the section line 3—3 in the normally open, off position.
Figure 3A:
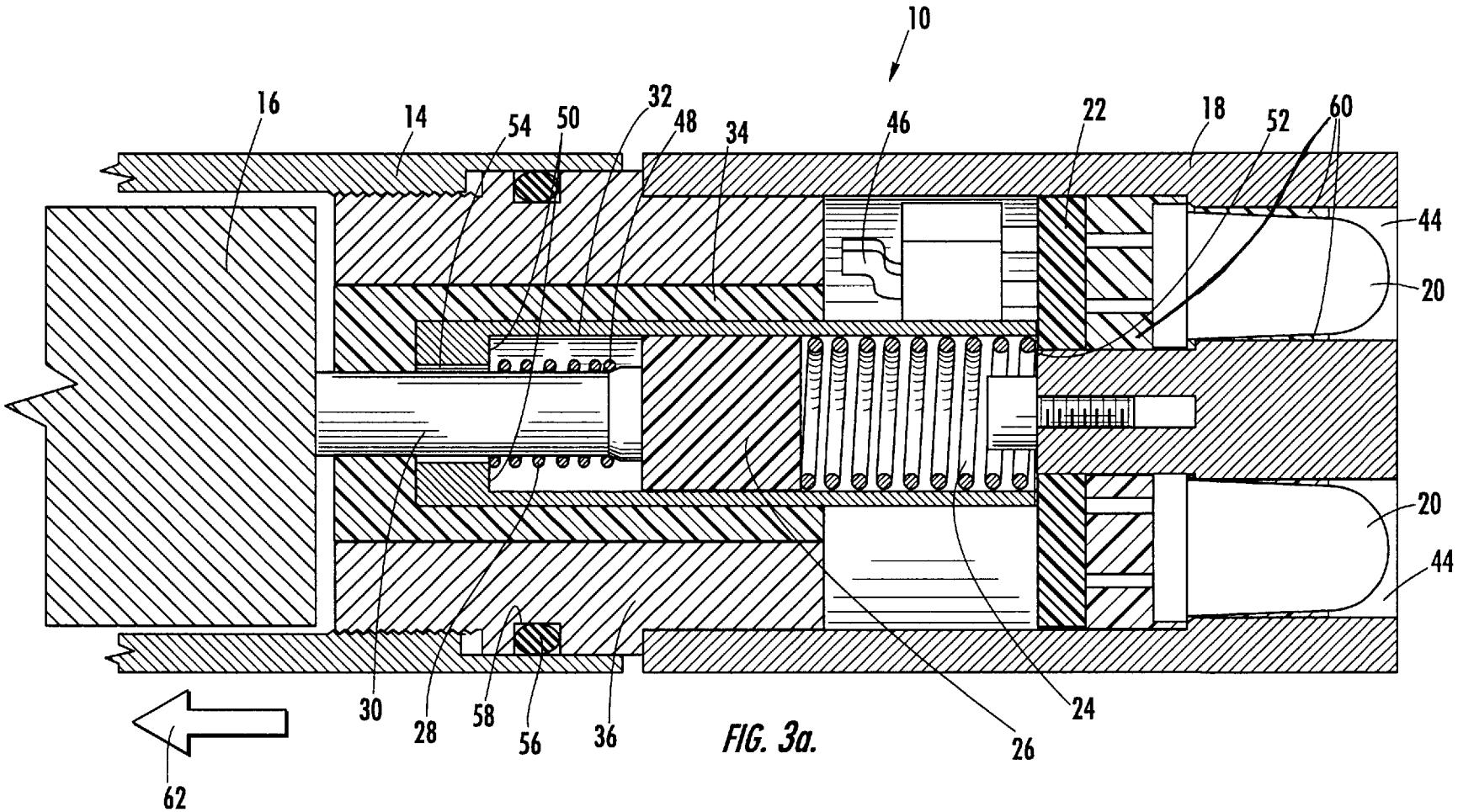
FIG. 3*a* is a cross-sectional view of the flashlight of the present invention in FIG. 1 along the section line 3—3 in the closed, on position.

Turning to FIGS. 3 and 3*a*, a section is shown of the flashlight 12 of the present invention in the operational state. FIG. 3 shows the flashlight 12 in the normally open, off state, and FIG. 3*a* shows the flashlight 12 in the closed, on state. In FIG. 3 the flashlight head 10 is shown threaded completely into the battery housing 14. In this state, as can be seen, there is a gap between contact spring 28 and the bottom surface of the switch contact 50. This gap is a break in the electrical circuit of the flashlight 12 and prevents the batteries 16 from energizing the LED lamps 20. While plunger 30 is spring biased by the force of spring 24 in the direction of the batteries 16, it is not allowed to move in the direction of the batteries 16 because of the proximity of the batteries 16 to the flashlight head 10. In other words, when the flashlight head 10 is screwed entirely onto the battery housing 14, the batteries 16 force the plunger upwardly against spring 24. Because the spring 28 is connected to the top of the plunger, the contact spring 28 is moved out of electrical contact with the bottom of the contact tube 32.

In FIG. 3*a,* the battery housing 14 is shown as being slightly unscrewed from the flashlight head 10 as indicated by the arrow 62, or vice versa, the head 10 is unthreaded from the body 14. This displacement of the battery housing 14 results in displacement of the batteries 16 from the flashlight head 10 by the same distance. Since the plunger 30 is spring biased in the direction of the batteries 16 by spring 24, this linear displacement of the batteries 16 allows the spring 24 to expand and thus displace the plunger 30 rearwardly by the same distance as the battery housing 14 and the batteries 16. Once the distance of displacement of the plunger 30 is sufficient, the contact spring 28 comes into contact with switch contact 50. When this contact is made it can be seen that a complete electrical circuit is provided starting at the top battery 16 contact through the plunger 30, the contact spring 24, switch contact 50, contact tube 32, secondary spring 24, central contact 52, into the circuit assembly 22 and the LED lamps 20, through contact tab 46, back into the outer housing 18, through the lower housing 36, into the battery housing 14 and finally to the bottom contact of battery 16. Therefore, by translating the battery housing 14 in a rearward direction 62 from the flashlight head 10 an electrical circuit is completed thereby energizing the flashlight 12.

It can also be seen in FIG. 3*a* that at the point where contact spring 28 initially contacts switch contact 50, the contact spring 28 is not compressed. Since the spring force in the secondary spring 24 is greater than the spring force in the contact spring 28, further displacement of the battery housing 14 and batteries 16 in the rearward direction 62 allows the plunger 30 to also be further displaced in the rearward direction 62. As the plunger 30 is further displaces by secondary spring 24, contact spring 28 is further compressed allowing the plunger 30 to remain in contact with the battery 16 until the contact spring 28 is completely compressed. The use of the contact spring 28 and secondary spring 24 in this manner provide for the extended operational range provided for under the present invention.

It can therefore be seen that the instant invention provides a compact inline flashlight switching mechanism that is fully enclosed and sealed against infiltration of water of other contaminants. It can be further seen that the present invention provides a novel reverse acting switch design that provides for smooth operation and an extended operational range through the use of spring contacts. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An electrical switch assembly comprising:

a power source having a first electrical contact and a second electrical contact;

an electrically insulative switch housing having a first end and a second end said first end being adjacent to said first electrical contact of said power source, said housing being slideable in a linear fashion in a first linear direction towards said first electrical contact of said power source and a second linear direction opposite said first linear direction;

a spring disposed within said switch housing;

an electrically conductive plunger having a first contact end and a second contact end, slideably received within said switch housing, said plunger being spring biased by said spring in said first direction wherein said first contact end is in electrical communication with said first electrical contact of said power source; and a switch contact received inside said first end of said switch housing said switch contact having a first contact end and a second contact end, said second contact end in electrical communication with said second electrical contact of said power source;

wherein sliding said switch housing in said second linear direction brings said first contact end of said switch contact into electrical communication with said second contact end of said plunger completing an electrical circuit.

2. An electrical switch assembly comprising:

a power source having a first electrical contact and a second electrical contact;

an electrically insulative switch housing having a first end and a second end said first end being adjacent to said first electrical contact of said power source, said housing being slideable in a linear fashion in a first linear direction towards said first electrical contact of said power source and a second linear direction opposite said first linear direction;

an electrically conductive plunger assembly having a first contact end and a second contact end, a widened shoulder at said second contact end of said plunger, a spring frictionally received around said widened shoulder, in electrical communication with said plunger and an electrically insulative guide frictionally connected to said second end of said plunger, said plunger assembly slideably received within said which housing, said plunger spring biased in said first direction wherein said first contact end is in electrical communication with said first electrical contact of said power sources; and a switch contact received inside said first end of said switch housing said switch contact having a first contact end and a second contact end, said second contact end in electrical communication with said second electrical contact of said power source;

wherein sliding said switch housing in said second linear direction brings said first contact end of said switch contact into electrical communication with said second contact end of said plunger completion an electrical circuit.

3. The electrical switch assembly of claim 2, wherein said switch contact further comprises:

an electrically conductive cylinder having a bottom wall forming said first contact end of said switch contact and an opening in said bottom wall, said cylinder being received between said switch housing and said plunger, wherein said first contact end of said plunger passes through said opening in said bottom wall and said electrically insulative guide supports said plunger within said cylinder out of electrical contact with said cylinder.

4. A flashlight assembly comprising:

a housing having an electrically conductive bottom wall and an electrically conductive side wall extending upwardly from said bottom wall and a threaded opening opposite said bottom wall;

a battery having a first contact and a second contact said battery received within said housing wherein said first contact is in electrical communication with said bottom wall;

a flashlight head having a front and a back, said back of said head being threaded and rotatably received in said opening in said housing, whereby rotating said head causes said head to move in a first linear direction away from the housing, said head being in electrical communication with said housing;

a light generating element having a first contact and a second contact, said light generating element received within said front of said head, said first contact in electrical communication with said head;

an electrically insulative switch housing having a first end and a second end received within said back of said head;

an electrically conductive plunger having a first contact end and a second contact end, slideably received within said switch housing, said plunger spring biased in a second direction opposite said first direction wherein said first contact end is in electrical communication with said second electrical contact of said battery; and a switch contact received inside said first end of said switch housing said switch contact having a first contact end and a second contact end, said second contact end in electrical communication with said second contact of said light generating source;

wherein sliding said switch housing in said second linear direction brings said first contact end of said switch contact into electrical communication with said second contact end of said plunger selectively energizing said light source.

5. The electrical switch assembly of claim 4, wherein said plunger further comprises:

a widened shoulder at said second contact end of said plunger;

a spring frictionally received around said widened shoulder, in electrical communication with said plunger; and an electrically insulative guide frictionally connected to said second end of said plunger.

6. The electrical switch assembly of claim 5, wherein said switch contact further comprises:

an electrically conductive cylinder having a bottom wall forming said first contact end of said switch contact and an opening in said bottom wall, said cylinder being received between said switch housing and said plunger, wherein said first contact end of said plunger passes through said opening in said bottom wall and said electrically insulative guide supports said plunger within said cylinder out of electrical contact with said cylinder.

7. The electrical switch assembly of claim 5, wherein said light generating source is a light emitting diode.

8. The electrical switch assembly of claim 5, wherein said light generating source further comprises:

a circuit board with a plurality of light emitting diodes mounted thereon.

9. A rotary switch assembly comprising:

an electrically conductive housing including an elongates tubular body portion having a closed end and an open end, and further including a head portion received in threaded relation with the open end of said body portion, said head portion being threadedly rotatable with respect to said body portion to provide a near axial movement of said head portion relative to said body portion;

a battery received within said open end of said housing and having a first contact end in electrical communication with the closed end of said housing;

a switch assembly mounted within said head portion of said housing and movable with said head portion when rotated, said switch assembly comprising a fixed contact mounted in fixed relation to said head portion, a plunger having a first end in engagement with a second contact end of said battery and a second end for making selective contact with said fixed contact, said plunger being slidably movable relative to said fixed contact, and a spring captured between said head portion and said plunger for biasing said plunger toward said battery;

said head portion and said body portion being rotatably movable relative to each other between an off position wherein said head portion and said body portion are fully threaded together such that said battery pushes said plunger inwardly against said spring and slidably moves said second contact end out of engagement with said fixed contact, and an on position wherein said head portion and said body portion are threaded at least partially apart such that said plunger is allowed by movement of said battery away from said head portion to be biased toward said battery and said second contact end thereof is slidably translated into engagement with said fixed contact within said head portion.

* * * * *